United States Patent [19]

Matsumoto et al.

[11] Patent Number: 4,615,965

[45] Date of Patent: Oct. 7, 1986

[54] METHOD OF MAKING PHOTOCONDUCTIVE FILM AND ELECTROPHOTOGRAPHIC PHOTOSENSITIVE MEMBER

[75] Inventors: Masakazu Matsumoto; Hideyuki Takahashi, both of Yokohama, Japan

[73] Assignee: Canon Kabushiki Kaisha, Tokyo, Japan

[21] Appl. No.: 721,652

[22] Filed: Apr. 10, 1985

[30] Foreign Application Priority Data

Apr. 13, 1984 [JP] Japan ..... 59-74774

[51] Int. Cl.[4] ..... G03G 5/06

[52] U.S. Cl. ..... 430/134

[58] Field of Search ..... 430/127, 134

[56] References Cited

U.S. PATENT DOCUMENTS 3,849,128 11/1974 Ihara ..... 430/133

*Primary Examiner*—John D. Welsh

*Attorney, Agent, or Firm*—Fitzpatrick, Cella, Harper & Scinto

[57] ABSTRACT

A photoconductive film is formed by applying a dispersion liquid produced by mixing a solution of a binder resin in a first solvent of high compatibility with the binder resin containing a photoconductive organic pigment or dye with a second solvent having compatibility with the binder resin inferior to the first solvent.

An electrophotographic photosensitive member having a photosensitive layer is formed by applying a dispersion liquid produced by mixing a solution of a binder resin in a first solvent of high compatibility with the binder resin containing a photoconductive organic pigment or dye with a second solvent having compatibility with the binder resin inferior to the first solvent.

An electrophotographic photosensitive member having a charge generation layer and a charge transport layer is formed by applying a dispersion liquid produced by mixing a solution of a binder resin in a first solvent of high compatibility with the binder resin containing a photoconductive organic pigment or dye with a second solvent having compatibility with the binder resin inferior to the first solvent.

16 Claims, 1 Drawing Figure

METHOD OF MAKING PHOTOCONDUCTIVE FILM AND ELECTROPHOTOGRAPHIC PHOTOSENSITIVE MEMBER

BACKGROUND OF THE INVENTION

1. Field of the Invention

This invention relates to a photo-conductive film and an electrophoto-graphic photosensitive member.

2. Description of the Prior Art

Heretofore, as an electrophotographic photosensitive member composed of an inorganic photoconductive material, there have been widely used selenium, cadmium sulfide, zinc oxide and the like.

On the other hand, as an electrophoto-graphic photosensitive member composed of an organic photoconductive material, there have been used electrophotographic photosensitive member composed of a photoconductive polymer such as poly-N-vinylcarbazol and the like, a low molecular weight organic photoconductive material such as 2,5-bis(p-diethylamino-phenyl)-1,3,4-oxadiazole and the like, a combination of the organic photoconductive material and various dyes and pigments, or the like.

Electrophotographic photosensitive members composed of organic photoconductive materials have advantages such as good film shapeability, capability of being produced by coating, very high productivity, and low cost. In addition, color sensitivity can be advantageously optionally controlled by selecting appropriately a sensitizer such as dyes, pigments and the like, and the investigation has been widely made.

In particular, there have been recently developed a photosensitive member of function separation type which comprises a charge generation layer composed of an organic photoconductive pigment and a so-called charge transport layer composed of the above-mentioned photoconductive polymer, low molecular weight organic photoconductive material or the like and therefore, the sensitivity and durability have been remarkably improved while conventional organic electrophotographic photosensitive members have only low sensitivity and durability, and the organic electrophotographic photosensitive members have recently become to be practically used. Furthermore, various compounds and pigments suitable for photosensitive members of function separation type have been found.

Since the photosensitive member of function separation type is composed of at least two layers, that is, a charge generation layer and a charge transport layer, charge carriers produced by light absorption at the charge generation layer is injected into the charge transport layer to eliminate the surface charge of the photosensitive member resulting in formation of electrostatic contrast. The role played by the charge generation layer in the above-mentioned process is very important. In other words, how many charge carriers are uniformly formed, how effectively the resulting charge carriers are injected into the charge transport layer, and how smoothly the reverse charge carriers flow into the support, in other words, most of electrophotographic characteristics such as electrostatic characteristics, image characteristics and the like, are dependent on the charge generation layer to a great extent.

In general, it is considered that electrophotographic characteristics become better according as the charge generation layer is more uniform, thinner and smoother, that is, the charge generation particles are finer. Therefore, the biggest problem in the practical use is how to produce stably a very thin layer. In order to solve this problem, there should be solved a problem of dispersibility, i.e. how to disperse in a fine powder form the pigments or dyes which are charge generation materials and a problem of dispersion stability, i.e. how to produce a dispersion liquid which is free from aggregation and stable.

As a method for producing a dispersion liquid of pigment or dye in a form of fine particles, in general, pigment or dye together with a binder is ground by a sand mill, ball mill, roll mill or attritor, and if the dispersion conditions are optimized, it is possible to pulverize to a considerable level. In addition, when pigment or dye is formed in a fine particle form in the synthesis and purification stages and the fine particle form is maintained by a certain technique, it is not difficult to prepare a dispersion liquid containing fine particles less than 0.1 $\mu$m in size of pigment or dye.

However, in general, the finer the pigment or dye particles, the larger the factors hindering the stability of coating liquid such as aggregation, thixotropy and the like. Thus, dispersibility often contradicts dispersion stability.

As to dispersion stability, in the field of paints which has an old history, there are almost established techniques such as using SP value for matching pigment or dye, binder and solvent, adding an additive, so-called dispersion stabilizer, and the like. On the contrary, there has not yet been established any technique capable of stabilizing a dispersion liquid of finer particles of pigment or dye for electrophotography, but the technique is still in a state of so-called "groping in the dark".

SUMMARY OF THE INVENTION

The present inventors have made various efforts to improve the stability of a dispersion liquid containing fine particles of pigment or dye, and found that, in the case of dispersing pigment or dye of a strong aggregating property, the agglomeration property is decreased remarkably when there is used, as a diluting solvent, a solvent having a compatibility with the binder poorer than that of a solvent used upon dispersing at first.

An object of the present invention is to provide a photoconductive film and an electrophotographic photosensitive member which contain uniformly organic pigment or dye in a form of fine particles.

Another object of the present invention is to provide a photoconductive film produced by using a stable dispersion liquid of organic pigment in a form of fine particles.

A further object of the present invention is to provide a photoconductive film and an electrophotographic photosensitive member having high sensitivity characteristics and stable potential characteristics upon repeated use. According to one aspect of the present invention there is provided a photoconductive film formed by applying a dispersion liquid produced by mixing a solution of a binder resin in a first solvent of high compatibility with the binder resin containing a photoconductive organic pigment or dye with a second solvent having compatibility with the binder resin inferior to the first solvent. According to another aspect of the present invention there is provided electrophotographic photosensitive member having a photosensitive layer formed by applying a dispersion liquid produced by mixing a solution of a binder resin in a first solvent of high compatibility with the binder resin containing a photoconductive organic pigment or dye with a second solvent having compatibility with the binder resin inferior to the first solvent. According to a further aspect of the present invention there is provided an electrophotographic photosensitive member having a charge generation layer and a charge transport layer formed by applying a dispersion liquid produced by mixing a solution of a binder resin in a first solvent of high compatibility with the binder resin containing a photoconductive organic pigment or dye with a second solvent having compatibility with the binder resin inferior to the first solvent.

DESCRIPTION OF THE PREFERRED EMBODIMENTS

Figure 1:
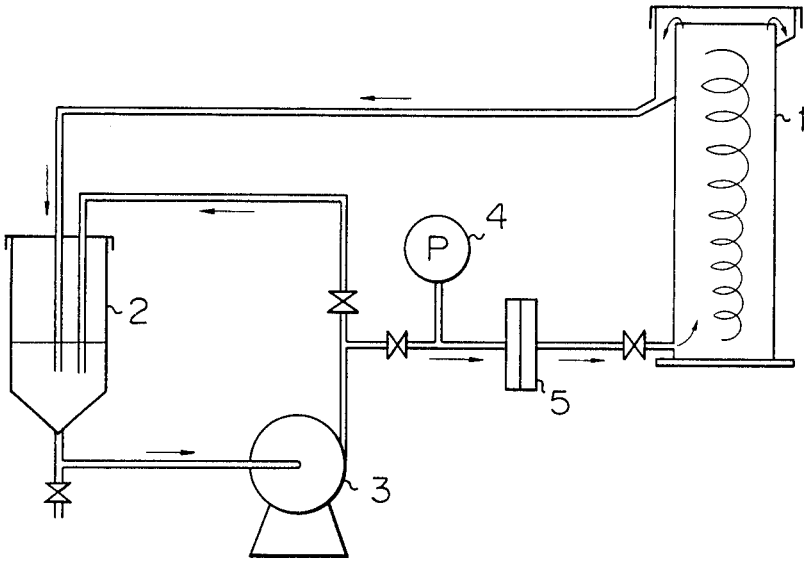
FIG. 1 shows a model of a circulation coating system.

In case that the above-mentioned pigment or dye is dispersed with a binder into a solvent by the known dispersion method, if a matching of the binder and the solvent with the pigment or the dye, the ratio of the binder to the pigment or the dye and so on are appropriate, a fine particle dispersion liquid of the pigment or the dye will be obtained. However, in most cases, the particles are aggregated with the lapse of time. Dilution delays the time at which aggregation state occurs, but does not essentially solve the problem of aggregation. The degree of dilution is limited depending on thickness of a coating film.

In case that a solvent different from a solvent used for dispersion and having compatibility with the binder inferior to that of the solvent used upon dilution, stability of the dispersion liquid become very good. This desired effect can be obtained whether the pigment and dye are in a dry powder form or in a solvent paste form. In case that a solvent has high compatibility, it is supposed that the binder molecule absorbed on the particle surface of the pigment or the dye has an extending portion to form a shape acceptable for the dispersion and at the same time, the extending portions intertwine easily to cause the aggregation. On the contrary, in the case of diluting with a solvent having a low compatibility with the binder after the dispersion, it is supposed that aggregation property is inhibited by diminution of the extending portion in the binder molecule.

A process of preparing the photoconductive compositions of the present invention will be described below in detail.

As the photoconductive organic pigment, there can be used azo pigment, phthalocyanine pigment, quinacridone pigment, cyanine pigment, pyrylium pigment, thiapyrylium pigment, indigo pigment, squaric acid pigment, polycyclic quinone pigment and the like for the charge generation material of the electrophotographic photosensitive member.

As the binder resin, there can be used polyvinyl butyral, formal resins, polyamide resins, polyurethan resins, cellosic resins, polyester resins, polysulfon resins, styrenic resins, polycarbonate resins, acrylic resins and the like.

As the dispersion solvent, there can be used a solvent compatible with the binder resin, for example, alocholic solvent such as methanol, ethanol, IPA and the like, ketonic solvent such as acetone, MEK, MIBK, cyclohexanone and the like, aromatic hydrocarbon solvent such as benzene, toluene, xylene, monochlorobenzene and the like, etheric solvent such as 1,4-dioxane, THF or IPE and the like and other various solvents such as DMF, acetonitrile, and the like. The compatibility is judged from solubility parameter, so-called SP-value, or viscosity.

The dilution solvent must be compatible with the binder, and is selected from alcohol series solvents such as methanol, ethanol, IPA and the like, ketone series solvents such as acetone, MEK, MIBK, cyclohexanone and the like, aromatic solvents such as benzene, toluene, xylene, monochlorobenzene and the like, ether series solvents such as 1,4-dioxane, THF, IPE and the like, ester series solvents such as ethyl acetate, butyl acetate and the like, and other various solvents such as DMF, acetonitrile and the like. It is preferable that SP-value of the dilution solvent is 0.5 or more smaller than that of the dispersion solvent, or that the viscosity value of the solution of the binder in the dilution solvent is 25% or more lower than that of the solution of the binder in the dispersion solvent. A mixture of two or more solvents may be used. In general, the more the quantity of the dilution solvent relative to that of the dispersion solvent, the more remarkable this effect. In case that the difference in SP-or viscosity value is within the above range and the amount of the dilution solvent is 50 wt. % or more based on the dispersion solvent, the effect is sufficiently notable. It is considered that the effect is attributable to the inhibition of aggregation caused by the decrease in compatibility of the binder with the dispersion solvent by addition of the dilution solvent and the resulting diminution of the molecular volume of the binder.

Pigment or dye is dispersed, in the form of powder or paste, with the binder resin and dispersion solvent as described above, and as a means of dispersion there can be properly used a known means such as a sand mill, a colloid mill, an attriter, a ball mill, a roll mill and the like. After the dispersion treatment, the resultant dispersion is diluted quickly with the above-mentioned dilution solvent. It is particularly effective to add the dilution liquid slowly to the dispersion under stirring.

In the present invention, colloidal dispersion of organic pigment or dye is remarkably stable, and is maintained without aggregation and alteration of viscosity for six or more months on standing under stopperd condition, and for two or more months in a model system of practical coating apparatuses equipped with circulation, filtration and stirring means.

The electrophotographic photosensitive member comprising a layer formed by coating the above dispersion and drying is found to be improved in sensitivity characteristics and charge characteristics upon repeated use.

A method for preparing the electrophotographic photosensitive member after the dispersion process is described as follows. The charge generation layer can be formed by applying the above-mentioned dispersion liquid directly on the electroconductive substrate or on the bond layer formed thereupon. Also, the charge generation layer can be formed by applying the dispersion liquid to the charge transport layer as described below. It is desired that thickness of the charge generation layer as a thin film is $5\mu$ or less, preferably $0.01-1\mu$. A lot of charge carriers are formed since most amount of incident rays in absorbed in the charge generation layer, and it is needed that the formed charge carrier is introduced into the charge transport layer without deactivation by recombination and trap. That is why the charge generation layer has desirably the above-mentioned layer thickness.

The coating can be carried out by a coating method such as a dipping coating method, a spray coating method, a spinner coating method, a bead coating method, a mayer bar coating method, a blade coating method, a roller coating method, a curtain coating method and the like. Drying is preferably carried out by a dust free, followed by oven drying. The oven drying can be carried out at temperatures of 30° C.–200° C. for 5 minutes–2 hours, and under a stationary condition or an air-blowing condition.

The charge transport layer is connected electrically with the above-menitoned charge generation layer and has the functions, i.e. receiving the charge carrier injected from the charge generation layer in the presence of an electric field and transporting these charge carriers to the surface. The charge transport layer may be formed on the charge generation layer or under that. Preferably, the charge transport layer is formed on the charge generation layer.

A photoconductive member has generally a function of transporting the charge carrier. Thus, the charge transport layer can be formed by the photoconductive member.

It is preferable that a substance transporting the charge carrier in the charge transport layer (hereinafter, simply referred to as "charge transport substance") is substantially insensitive to the wavelength region of an electromagnetic wave to which the charge generation layer has sensitivity. The term "electromagnetic wave" herein means "ray" in a broad sense including $\gamma$-rays, X rays, ultraviolet rays, visible rays, near infrared rays, infrared rays, far infrared rays and so on. In the case where the photosensitive wavelength region of the charge transport layer corresponds with or overlaps with that of the charge generation layer, the charge carriers generated in both layers capture each other to cause lowering of sensitivity.

The charge transport substance includes an electron-transporting substance and a positive hole transporting substance. The electron transporting substance includes an electron attractive substance such as chloranil, bromanil, tetracyanoethylene, tetracyanoquinodimethane, 2,4,7-trinitro-9-fluorenone, 2,4,5,7-tetranitro-9-fluorenone, 2,4,7 trinitro-9-dicyanomethylenefluorenone, 2,4,5,7-tetra-nitroxanthone, 2,4,8 trinitrothioxanthone, and the like and polymer thereof.

The positive hole transporting substance includes pyrene, N-ethyl carbazole, N-isopropylcarbazole, N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine; hydrazones such as p-diethylaminobenzaldehyde-N,N-diphenylhydrazone, p-diethylaminobenzaldehyde-N-$\alpha$-naphthyl-N-phenylhydrazone, p-pyrrolidino benzaldehyde-N,N-diphenylhydrazone, 1,3,3-trimethylindolenine-$\omega$-aldehyde-N,N-diphenylhydrazone, p-diethylbenzaldhyde-3-methylbenzthiazolinone-2-hydrazone and the like; 2,5-bis(p-diethylaminophenyl)-1,3,4-oxadiazole; pyrazolines such as 1-phenyl-3-(p-diethylaminostyryl)-5-(p-diethylaminophenyl)pyrazoline, 1-[quinolyl(2)]-3-(p-diethylaminostyryl)-5-(p-diethylaminophenyl) pyrazoline, 1-[pyridyl(2)]-3-(p-diethylaminostyryl)-5-(p-diethylaminophenyl) pyrazoline, 1-[6-methoxypyridyl (2)]-3-(p-diethylaminostyryl)-5-(p-diethylaminophenyl) pyrazoline, 1-[pyridyl(3)]-3-(p-diethylaminostyryl)-5-(p-diethyl-aminophenyl) pyrazoline, 1-[lepidyl (2)]-3-(p-diethylamino-styryl)-5-(p-diethylaminophenyl) pyrazoline, 1-[pyridyl (2)]-3-(p-diethylaminostyryl)-4-methyl-5-(p-diethylamino-phenyl) pyrazoline, 1-[pyridyl (2)]-3($\alpha$-methyl-p-diethylaminostyryl)-5-(p-diethylaminophenyl) pyrazoline, 1-phenyl-3-(p-diethylaminostyryl)-4-methyl-5-(p-diethylaminophenyl) pyrazoline, 1-phenyl-3-($\alpha$-benzyl-p-diethylaminostyryl)-5-(p-diethylaminophenyl) pyrazoline, spiropyrazoline and the like; oxazole type compounds such as 2-(p-diethyl-aminostyryl)-6-diethylaminobenzoxazole, 2-(p-diethylaminophenyl)-4-(p-dimethylaminophenyl)-5-(2-chlorophenyl) oxazole and the like; thiazole type compounds such as 2-(p-diethylaminostyryl)-6-diethylaminobenzothiazole and the like; triarylmethane type compounds such as bis-(4-diethylamino-2-methylphenyl)phenylmethane and the like; polyarylalkanes such as 1,1-bis(4-N,N-diethylamino-2-methylphenyl) heptane, 1,1,2,2-tetrakis(4-N,N-dimethylamino-2-methylphenyl) ethane and the like; triphenylamine; and resins such as poly-N-vinyl-carbazole, polyvinyl pyrene, polyvinylanthracene, poly-vinylacridine, poly-9-vinylphenylathracene, pyrene-formaldehyde resin, and ethylcarbazole-formaldehyde resin.

In addition to the organic charge transport substance, there may be used inorganic material such as selenium, selenium-tellurium, amorphous silicon, cadmium sulfide, and the like. The charge transport substance may be used singly or in combination of two or more.

When charge transport substance has no film forming property, the film formation can be carried out by selecting a suitable binder.

Usable resin for binder includes an insulating resin such as acrylic resin, polyacrylate, polyester, polycarbonate, polystyrene, acrylonitrile-styrene copolymer, acrylonitrile-butadiene copolymer, polyvinyl butyral, polyvinylformal, polysulfone, polyacrylamide, polyamide, chlorinated rubber, and the like; or an organic photoconductive polymer such as poly-N-vinylcarbazole, polyvinyl anthracene, polyvinylpyrene, and the like.

Since there is a limit for transporting charge carrier, the charge transport layer can not be thicker than a certain necessary thickness needed. The thickness is generally 5 to 30 $\mu$m, preferably 8 to 20 $\mu$m. When the charge transport layer is formed by coating, a suitable process described above may be used.

The photosensitive layer in which the charge generation and transport layers, are formed successively is formed on a substrate having a conductive layer. As the substrate having the conductive layer there may be used a substrate which itself is conductive, for example, aluminum, aluminum alloy, copper, zinc, stainless steel, vanadium, molybdenum, chromium, titanium, nickel, indium, gold, platinum and the like. In addition, there may be used plastics such as polyethylene, polypropylene, polyvinyl chlorides, polyethylene terephthalate, acrylic resin, polyfluoroethylene, and the like having a layer formed by vacuum deposition of aluminum, aluminum alloy, indium oxide, tin oxide, indium oxide-tin oxide alloy or the like; a substrate composed of a plastic coated with an appropriate binder and conductive particles such as carbon black, silver particles and the like, a substrate composed of a plastic or paper impregnated with conductive particles; a plastic having conductive polymer; and the like. Between a conductive layer and a photosensitive layer, there may be provided an undercoating layer having both functions of barrier and adhesion. The under-coating layer may be formed by casein, polyvinyl alcohol, nitro cellulose, ethylene-acrylic acid copolymer, polyamide (nylon 6, nylon 66, nylon 610, nylon copolymer, alkoxymethyl nylon, and the like), polyurethane, gelatine, aluminum oxide, or the like.

Thickness of the under-coating layer is 0.1 to 5 μm, preferably 0.3 to 3 μm.

In using the photosensitive member in which a conductive layer, a charge generation layer and a charge transport layer are formed successively, when the charge transport substance is composed of an electron transporting substance, it is necessary that the surface of the charge transport layer is charged positively. By exposure after charging, the electrons generated in the charge generation layer are injected into the charge transport layer at the exposed portion and then reach the surface to neutralize the positive charge and attenuate the surface potential, thereby forming electrostatic contrast between the non-exposed portion and the exposed portion. The resulting electrostatic latent image is developed with a toner capable of being charged negatively to obtain a visible image. This may be directly fixed or may be developed and fixed after transferring the toner image to paper, a plastic film or the like.

Also, electrostatic latent images on a photosensitive member may be transferred to an insulating layer of a receiving paper followed by developing and then fixing.

There may be used known developers and known methods of developing and fixing without limitation.

On the other, when the charge transport substance is composed of a positive hole transporting substance, it is necessary that the surface of the charge transport layer is charged negatively. By exposure after charging, the positive holes generated in the charge generation layer are injected into the charge transport layer at the exposured portion and thereafter reaches the surface to neutralize the negative charge and attenuate the surface potential thereby forming electrostatic contrast between the non-exposed portion and the exposed portion. It is necessary that a toner capable of being charged positively is used for the development, in opposition to the case in which the electron transporting substance is used.

As other embodiment of the photosensitive member composed of the photoconductive composition according to the present invention, there may be mentioned an electrophotographic photosensitive member where one layer contains the above-mentioned photoconductive organic pigment together with the charge transport substance. On this occasion, in addition to the above-mentioned charge transport substance, a charge-transfer complex comprising poly-N-vinylcarbazole and trinitrofluorenone can be used.

The electrophotographic photosensitive member in this embodiment can be prepared by dispersing the above-mentioned organic photoconductor and charge transfer complex into a solution of polyester in tetrahydrofuran and forming a film.

Any photosensitive members contain at least one kind of pigment and, if desired, two or more kinds of pigments may be used for raising the sensitivity of the photosensitive member in which the pigments having different light absorptions are combined or obtaining panchromatic photosensitive members and so on.

The electrophotographic photosensitive member using the photoconductive composition according to the present invention can be used not only for electrophotographic copying machines but also widely used for a laser printer, a CRT printer and so on in an application field of the electrophotography.

Also, the photoconductive composition according to the present invention can be used for a solar battery and a photosensor in addition to the above-mentioned electrophotographic photosensitive member.

The present invention is described by referring to the folliwng Examples.

EXAMPLE 1 and COMPARISON EXAMPLE 1

80 ml of water, 16.6 ml (0.19 mol) of conc. hydrochloric acid and 6.53 g (0.029 mol) of diamine represented by the following formula

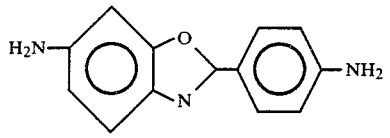

were placed in a 500 ml-beaker and stirred on ice-cold water bath to cool to 3° C. To the mixture was added dropwise a solution of 4.2 g. (0.061 mol) of sodium nitrite in 7 ml of water over 10 minutes while the reaction solution temperature was kept at 3° to 10° C. After addition, the solution was stirred at the same temperature for another 30 minutes. To the reaction liquid was added carbon and filtered to give a liquid containing a tetraazo compound.

Further, 21 g. of sodium hydroxide was dissolved in 700 ml of water in 2 liter-beaker. 16.2 g. (0.061 mol) of naphthol AS (3-hydroxy-2-naphthoic acid anilide) was added to the solution.

The resulting coupler solution was cooled to 6° C., and the tetraazo liquid as mentioned above was added dropwise with stirring over 30 minutes while the reaction temperature was kept at 6° to 10° C. After the addition, the mixture was stirred at room temperature for 2 hours and left overnight. The reaction mixture was filtered and washed with water to yield 19.08 grams of a crude pigment. Then, the resulting pigment was washed with N,N-dimethylformamide (400 ml×5 times) and washed further with MEK (500 ml×3 times). Thereafter, the pigment was dryed at 80° C. for 6 hours by using a vacuum dryer to obtain 14.3 grams (yield, 75%) of the powdered refined pigment having the following formula.

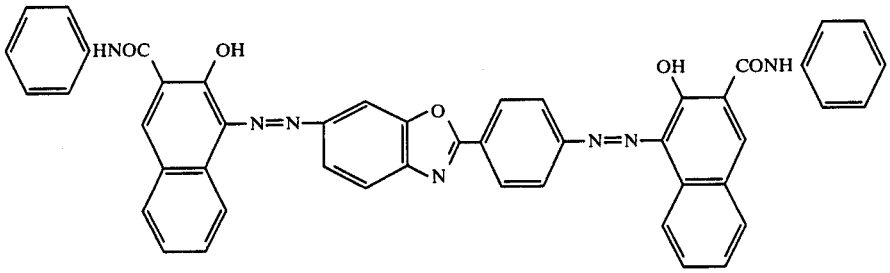

Next, 7 g, of the above dry pigment was added to a solution prepared by dissolving 3.5 g. of butyral resin (butralization degree 63 mol %, SP value $\delta m = 9.3 \sim 10.8$) in 200 g. of cyclohexanone SP value $\delta m = 9.89$ of cyclohexanone. The mixture was dispersed for 4 hours by use of a attritor. Sample Liquid-1 was prepared by diluting the dispersion liquid with 200 g. of MEK (SP value $\delta m = 9.08$).

Additionally, Comparison Liquid-1 was also prepared in the same manner as mentioned above except for diluting with 250 g. of cyclohexanone.

Sp values are based on the values described in "Polymer Hand Book, 2nd ed., pub. by A. Wiley, Interscience Publication".

Viscosity was measured by using a single cylindrical rotating viscometer (Vismetron VS-A1:trademane, manufactured by Toshiba System K.K).

The measuring condition is as follows:

rotation frequency ; 60 r.p.m. (A rotor for low viscosity was used.)

measuring time; after 5 minutes from start measuring temperature; 30±0.1° C.

Stability with respect to two kinds of dispersion liquids as mentioned above was measured by the following three methods.

(1) Closed shelf test (standing under stoppered condition)

(2) Opened shelf test (The loss of a solvent due to vaporization was made up.)

(3) Continuous running test by using a circulation coating model system (FIG. 1) comprising a vessel for circulation, a circulating pump, a pressure gauge and a filter.

Aggregation property was measured by observing whether a filter paper was clogged upon filtration (whether the pressure indicated by the pressure gauge increased), and observing whether particle-like matters attached to a dry film when an aluminum sheet was dipped in the dispersion liquid and then pulled up, and stability of the dispersion liquid was evaluated by taking the change in viscosity with the lapse of time into consideration.

In FIG. 1, 1 is a vessel for circulation, 2 a liquid reservoir, 3 a circulating pump, 4 a pressure gauge and 5 a filter. The results and average particle size in dispersion liquids are shown in Table 1 (infra).

As is apparent from the above, the dispersion liquid diluted with MEK is remarkably increased in stability in comparison with others.

An aqueous ammonia solution of casein (casein 11.2 g., 28% aqueous ammonia lg. and water 222 ml) was applied to an aluminum plate by using a mayer bar in the thickness of 1.0 μm (dried), and dried.

Sample liquid-1 which was previously dispersed was applied to the resulting casein layer by using a mayer bar in the thickness of 0.3 μm (dried) and dried to form a charge generation layer.

Then, 5 g. of p-diethylaminobenzaldehyde-N,N-diphenylhydrazone and 5 g. of polymethacrylate resin (number average molecular weight 100,000) were dissolved in 70 ml of benzene. The solution was applied to the charge generation layer by using a mayer bar in the thickness of 12 μm (dried), and dried to form a charge transport layer. The resultant member was used as Sample 1.

On the other hand, for the purpose of comparison, a dispersion liquid, i.e. Comparison liquid-1 was prepared as above and, at the next day, the resulting Comparison liquid-1 was coated and dried in the same manner as above to form Comparison-1.

Using an apparatus for testing electrostatic copying paper, "Model sp-428", manufactured by Kawaguchi Denki, the electrophotographic photosensitive member thus produced was corona-charged at −5 KV by a static system, kept in the dark for one second, and exposed at 5 lux of illumination to investigate the charging characteristics.

As the charging characteristics, there was measured the surface potential ($V_D$) and the exposure amount ($E_{\frac{1}{2}}$) required for attenuating the potential(obtained when dark-attenuated for one second) to ½ of said potential value. The results are shown in Table 2 (infra).

For measuring fluctuations of potentials at light portions and dark portions upon repeated use, the photosensitive members prepared in this example were adhered to a cylinder of an electrophotographic copying machine equipped with a corona-charger of a voltage of −5.6 KV, an optical exposure system of 12 lux·sec of light exposure amount, a developing device, a transferring charger, a discharging exposure optical system and a cleaner. This copying machine gave images on a receiving paper as the cylinder is driven.

Using this copying machine, there were measured initial potentials at light portions ($V_L$) and dark portions ($V_D$) and potentials after copying 5000 times at light portions ($V_L$) and dark portions ($V_D$) The results are shown in Table 3 (infra).

As is clear from the results in Tables 2 and 3, the photosensitive member according to the present invention has excellent sensitivity and excellent stability of $V_D$ and $V_L$ when the members are repeatedly used.

TABLE 1

| | Average particle diameter | Stability with the lapse of time: Testing method | Period required for aggregating | Period for stable viscosity |
|---|---|---|---|---|
| Sample Liquid-1 | 0.18 | Closed leaving | 6 months | 6 months |
| | | Opened leaving | 5 months | 4 months |
| | | Circulation | 2 months | 2 months |

TABLE 1-continued

| | Average particle diameter | Stability with the lapse of time: Testing method | Period required for aggregating | Period for stable viscosity |
|---|---|---|---|---|
| | | model system | | |
| Comparison Liquid-1 | 0.12 | Closed leaving | 1 month | |
| | | Opened leaving | 1 month | |
| | | Circulation model system | 3 days | |

TABLE 2

| | $V_D(-V)$ | $E_{\frac{1}{2}}$(lux · sec) |
|---|---|---|
| Sample-1 | 585 | 3.9 |
| Comparison-1 | 585 | 4.8 |

TABLE 3

| | Initial | | after 5000 runs | |
|---|---|---|---|---|
| | $V_D(-V)$ | $V_L(-V)$ | $V_D(-V)$ | $V_L(-V)$ |
| Sample-1 | 580 | 30 | 570 | 40 |
| Comparison-1 | 570 | 55 | 560 | 65 |

EXAMPLE 2 and COMPARISON EXAMPLES 2 and 3

148 grams of phthalic anhydride, 180 grams of urea, 25 grams of cuprous chloride, 0.3 grams of ammonium molybdate and 370 grams of benzoic acid were reacted at 190° C. for 3.5 hours while stirring and heating. After the reaction was finished, benzoic acid distilled under reduced pressure. The residue was washed with water and filtered, followed by washing with an acid and filtering, re-washing with water and re-filtering to give 130 grams of crude copper phthalocyanine.

The crude phthalocyanine was dissolved in 1300 grams of conc. $H_2SO_4$ and stirred at room temperature for two hours. The mixture was poured into a lot of ice-cold water. The pigment thus precipitated was filtered, and then washed with water until it became neutral.

Then, it was repeated six times with DMF(26l) to stir and filter the pigment, and further two times with THF(2,6l) to yield 467 grams of THF paste of the refined copper phthalocyanine (27% solids by weight, 126 grams).

2.5 grams of cellulose acetate butyrate resin was then dissolved in 100 grams of THF. To the resulting THF solution was added 18.5 grams (corresponding to 5 grams of solids) of the THF paste of the pigment as mentioned above. The mixture was dispersed for 40 hours by use of a ball mill, and diluted with 120 grams of ethyl acetate. The resulting liquid is called Sample Liquid-2.

In the same manner as above, Comparison Liquid-2 was prepared by diluting with 80 grams of ethyl acetate less than that in Sample Liquid-2 and Comparison Liquid-3 was prepared by diluting with 120 grams of THF.

Concerning these three kinds of liquids, the stability with the lapse of time was evaluated by means of the circulation model system as described in Example 1. The following results were obtained (Table 4).

TABLE 4

| | Average particle Diameter (μm) | Stability with the lapse of time: Period required for aggregating | Period for stable viscosity |
|---|---|---|---|
| Sample Liquid 2 | 0.07 | 3 months | 2.5 months |
| Comparison Liquid 2 | 0.08 | 20 days | 12 days |
| Comparison Liquid 3 | 0.09 | 15 days | 12 days |

Viscosties of a 2% THF solution and a 2% ethyl acetate solution of the cellulose acetate butyrate resin were 2.3 cps and 1.6 cps, respectively. Viscosity of the ethyl acetate solution was 30% lower than that of the THF solution.

It is clear from the above that Sample Liquid-2 is remarkably stable in comparison with Comparison Liquid-2 and 3.

Repeating the procedure of Example 1 except that the above-mentioned Sample Liquid-2, Comparison Liquid-2 and Comparison Liquid-3 were used in place of Sample Liquid-1 which was used for preparing the photosensitive member of Example 1, there were produced respective photosensitive members, which were measured with respect to charging characteristics (Table 5) and durability (Table 6) in a way similar to the measuring methods in Example 1. The results are as shown below.

TABLE 5

| | $V_D(-V)$ | $E_{\frac{1}{2}}$(lux · sec) |
|---|---|---|
| Sample 2 | 575 | 4.2 |
| Comparison 2 | 575 | 6.3 |
| Comparison 3 | 575 | 6.7 |

TABLE 6

| | at initial run | | after 5000 runs | |
|---|---|---|---|---|
| | $V_D(-V)$ | $V_L(1-V)$ | $V_D(-V)$ | $V_L(-V)$ |
| Sample 2 | 580 | 30 | 575 | 35 |
| Comparison 2 | 570 | 60 | 550 | 65 |
| Comparison 3 | 575 | 55 | 570 | 65 |

EXAMPLES 3-7 and COMPARISON EXAMPLES 4 and 5

A dispersion liquid of the pigment in cyclohexanone was prepared in the same manner as in Example 1, and then Sample Liquids were respectively prepared by diluting the above dispersion liquid with 2 times, 0.7 times, 0.5 times and 0.3 times of the amount of MEK used as a diluting solvent in Example 1. Other Sample Liquids were also prepared by using the same amount of a diluting solvent as in Example 1 and changing the content of cyclohexanone to 20%, 40% and 60%.

The resulting Sample Liquids were evaluated by means of the circulation model system as in Example 1. The results, SP values and the ratios of the vistosity of 2% binder solution to the viscosity of 2% cyclohexanone solution the viscosity of 2% cyclohexanone solution is taken 1.0 are shown in Table 7.

TABLE 7

| | The amount of a diluting solvent (when the amount of a diluting solvent used in Example 1 is assumed as 1.0) | The content of cyclo-hexanone (%) | SP value (δ m) | The ratio of the vis-cosity of 2% solution | Stability with the lapse of time: Period required for dispersions aggregating | Period for stable vis-cosity |
|---|---|---|---|---|---|---|
| Example | | | | | | |
| 3 | 2.0 | 0 | 9.27 | 0.61 | 4 months | 3 months |
| 4 | 0.7 | 0 | 9.27 | 0.61 | 3 months | 2.5 months |
| 5 | 0.5 | 0 | 9.27 | 0.61 | 2 months | 2 months |
| 6 | 1.0 | 20 | 9.77 | 0.68 | 2.5 months | 2.5 months |
| 7 | 1.0 | 40 | 9.64 | 0.73 | 1.5 months | 1.5 months |
| comparison example | | | | | | |
| 4 | 1.0 | 60 | 9.52 | 0.81 | 20 days | 15 days |
| 5 | 0.3 | 0 | 9.27 | 0.61 | 15 days | 20 days |

As is clear from the above results, the stability with the laspe of time is remarkably improved when the amount of a diluting solvent is more than a half of the amount of a dispersion solvent. This is also the case where the ratio of the viscosity of 2% solution is 0.75 or less.

The Sample Liquids in Examples 3–7 were respectively used for preparing photosensitive members in a manner similar to Example 1. Then, the charging properties and durability of the Sample Liquids were measured by a method similar to that Example 1. Good results as in Examples 1 and 2 were obtained

EXAMPLES 8–10 and COMPARISON EXAMPLES 6–9

A dispersion liquid of the pigment in cyclohexanone was prepared in the same manner as in Example 1, and then sample Liquids were prepared by using ethyl acetate, acetonitrile, acetone, THF, MIBK, n-propanol and toluene in place of MEK. The Sample Liquids were evaluated by means of the circulation model system as in Example 1. The following Table 8 shows the results, SP values, the ratios of the viscosity of 2% solution and compatibities thereof.

TABLE 8

| | Diluting solvent | SP value (δm) | The ratio of the viscosity of 2% solution | compatibility | Stability with the lapse of time: Period required for dispersions aggregating | Period for stable vis-cosity |
|---|---|---|---|---|---|---|
| Example | | | | | | |
| 8 | ethyl acetate | 9.08 | 0.66 | good | 3.5 months | 3 months |
| 9 | acetonitrile | 12.25 | 0.73 | good | 2.0 months | 2.0 months |
| 10 | acetone | 9.75 | 0.58 | good | 3.0 months | 2.0 months |
| Comparison Example | | | | | | |
| 6 | THF | 9.52 | 0.76 | good | 25 days | 21 days |
| 7 | MIBK | 8.31 | 0.71 | no good | — | — |
| 8 | n-propanol | 11.97 | 1.12 | good | 5 days | 3 days |
| 9 | toluene | 8.90 | — | no good | — | — |

As is clear from above, when sample liquids satisfy the following conditions, that is, SP value of the diluting solvent is 0.5 or more lower than SP value of cyclohexanone, 9.89, or the ratio of the viscosity of a 2% binder solution to the viscosity of a 2% cyclohexanone solution (the viscosity of 2% cyclohexanone solution is taken 1.0) is 0.75 or less, and the compatibility is good, the sample liquids are stable with the lapse of time.

Photosensitive members were prepared by using Sample Liquids in Examples 8–10 in a manner similar to that in Example 1. Then, the charging properties and durability thereof were measured by a method similar to that in Example 1. Good results were obtained as in Examples 1 and 2.

What we claim is:

1. A photoconductive film formed by the steps of:

(a) combining a binder resin containing an organic photoconductive dye or pigment with a first solvent to form a dispersion;

(b) admixing said dispersion with a second solvent, wherein the binder resin is less soluble in the second solvent than in the first solvent, to form a diluted dispersion; and (c) applying said diluted dispersion to a surface.

2. A photoconductive film according to claim 1 in which viscosity value of a solution of the binder resin in the second solvent is 25% or more lower than that of a solution of the same resin in the same amount as above in the first solvent.

3. A photoconductive film according to claim 1 in which solubility parameter SP value of the second solvent is 0.5 or more smaller than that of the first solvent.

4. A photoconductive film according to claim 1 in which the pigment or the dye is at least one member selected from the group consisting of azo compound, phthalocyanine compound, quinacridone compound, cyanine 5 compound, pyrylium compound, thiapyrylium compound, indigo compound, squaric acid compound, and polycylic quinone compound.

5. A photoconductive film according to claim 1 in which the binder resin is at least one member selected from the group consisting of polyvinyl butyral resin, formal resin, polyamide resin, polyurethane resin, cellulosic resin, polyester resin, polysulfone resin, styrene resin, polycarbonate resin and acrylic resin.

6. A photoconductive film according to claim 2 in which the first solvent is at least one member selected from the group consisting of alcohol, ketonic solvent, aromatic hydrocarbons solvent, and etheric solvent.

7. A photoconductive film according to claim 2 in which the second solvent is at least one member selected from alcoholic solvent, ketone, aromatic hydrocarbon, and etheric solvent.

8. A photoconductive film according to claim 1 in which the amount of second solvent in the dispersion solvent is 50 wt % or more based on the first solvent.

9. A photoconductive film formed by the steps of:

(a) combining a binder resin containing an organic photoconductive dye or pigment with a first solvent to form a dispersion;

(b) admixing said dispersion with a second solvent, wherein the binder resin is less soluble in the second solvent than in the first solvent, to form a diluted dispersion; and (c) applying said diluted dispersion to a substrate.

10. An electrophotographic photosensitive member according to claim 9 in which viscosity of a solution of the binder resin in the second solvent is 25% or more lower than that of a solution of the same resin in the same amount as above in the first solvent.

11. An electrophotographic photosensitive member according to claim 9 in which solubility parameter SP value of the second solvent is 0.5 or more smaller than that of the first solvent.

12. An electrophotographic photosensitive member according to claim 9 in which the photoconductive organic pigment or dye is at least one member selected from the group consisting of azo compound, phthalocyanine compound, quinacridone, cyanine compound, pyrylium compound, thiapyrylium compound, indigo compound, squaric acid compound, and polycyclic quinone compound.

13. An electrophotographic photosensitive member having a charge generation layer and a charge transport layer formed by applying a dispersion liquid produced by mixing a solution of a binder resin in a first solvent of high compatibility with the binder resin containing a photoconductive organic pigment or dye with a second solvent having compatibility with the binder resin inferior to the first solvent.

14. An electrophotographic photosensitive member according to claim 13 in which viscosity of a solution of a binder resin in the second solvent is 25% or more lower than that of a solution of the same resin in the same amount as above in the first solvent.

15. An electrophotographic photosensitive member according to claim 13 in which solubility parameter SP value of the second solvent is 0.5 or more smaller than that of the first solvent.

16. An electrophotographic photosensitive member according to claim 13 in which the photoconductive organic pigment or dye is at least one member selected from the group consisting of azo compound, phthalocyanine compound, quinacridone, cyanine compound, pyrylium compound, thiapyrylium compound, indigo compound, squaric acid compound, and polycylic quinone compound.

* * * * *

UNITED STATES PATENT AND TRADEMARK OFFICE

CERTIFICATE OF CORRECTION

PATENT NO. : 4,615,965

DATED : October 7, 1986

INVENTOR(S) : MASAKAZU MATSUMOTO, ET AL.

It is certified that error appears in the above-identified patent and that said Letters Patent is hereby corrected as shown below:

COLUMN 1

Line 8, "photo-conductive" should read --photoconductive--.
Line 9, "electrophoto-graphic" should read --electrophotographic--.
Line 15, "electrophoto-graphic" should read --electrophotographic--.

COLUMN 2

Line 47, "contain" should read --contains--.

COLUMN 3

Line 32, "solvent" should read --solvent,--.
Line 35, "become" should read --becomes--.
Line 65, "solvent" should read --solvents--.
Line 66, "solvent" should read --solvents--.
Line 67, "solvent" should read --solvents--.

COLUMN 4

Line 1, "solvent" should read --solvents--.
Line 65, "rays in" should read --rays is--.

COLUMN 5

Line 14, "menitoned" should read --mentioned--.
Line 32, "X" should read -- X- --.

UNITED STATES PATENT AND TRADEMARK OFFICE

CERTIFICATE OF CORRECTION

PATENT NO. : 4,615,965

DATED : October 7, 1986

INVENTOR(S) : MASAKAZU MATSUMOTO, ET AL.

It is certified that error appears in the above-identified patent and that said Letters Patent is hereby corrected as shown below:

COLUMN 6

Line 18, "methylphenyl)phenylmethane" should read --methylphenyl)-phenylmethane--.

COLUMN 7

Line 35, "other," should read --other hand,--.
Line 51, "other" should read --another--.

COLUMN 11

Line 35, "distilled" should read --was distilled--.

COLUMN 12

Line 14, "Viscosties" should read --Viscosities--.
Line 65, "vistosity" should read --viscosity--.

COLUMN 13

Line 29, "that" should read --that in--.
Line 42, "compatibities" should read --compatibilities--.

UNITED STATES PATENT AND TRADEMARK OFFICE

CERTIFICATE OF CORRECTION

PATENT NO. : 4,615,965

DATED : October 7, 1986 Page 3 of 3

INVENTOR(S) : MASAKAZU MATSUMOTO, ET AL.

It is certified that error appears in the above-identified patent and that said Letters Patent is hereby corrected as shown below:

COLUMN 14

Line 60 (in Claim 4), "5" should be deleted.

Signed and Sealed this

Tenth Day of March, 1987

*Attest:*

DONALD J. QUIGG

*Attesting Officer*

*Commissioner of Patents and Trademarks*